US009493868B2

(12) United States Patent
Tsuru et al.

(10) Patent No.: US 9,493,868 B2
(45) Date of Patent: Nov. 15, 2016

(54) ALUMINUM OR ALUMINUM ALLOY-COATED STEEL MATERIAL AND METHOD OF MANUFACTURING THE SAME

(71) Applicants: JFE Steel Corporation, Tokyo (JP); Tokyo Institute of Technology, Tokyo (JP)

(72) Inventors: Tooru Tsuru, Tokyo (JP); Toshio Maruyama, Tokyo (JP); Tatsuo Sato, Tokyo (JP); Masao Takeyama, Tokyo (JP); Masahiro Yoshida, Tokyo (JP); Sakae Fujita, Tokyo (JP); Sachiko Suzuki, Tokyo (JP); Satoru Ando, Tokyo (JP); Hiroki Nakamaru, Tokyo (JP)

(73) Assignees: JFE Steel Corporation (JP); Tokyo Institute of Technology (JP)

( * ) Notice: Subject to any disclaimer, the term of this patent is extended or adjusted under 35 U.S.C. 154(b) by 0 days.

(21) Appl. No.: 14/364,357

(22) PCT Filed: Dec. 10, 2012

(86) PCT No.: PCT/JP2012/082591
§ 371 (c)(1),
(2) Date: Jun. 11, 2014

(87) PCT Pub. No.: WO2013/089262
PCT Pub. Date: Jun. 20, 2013

(65) Prior Publication Data

US 2014/0377583 A1 Dec. 25, 2014

(30) Foreign Application Priority Data

Dec. 12, 2011 (JP) ..... 2011-271533

(51) Int. Cl.
*B32B 15/01* (2006.01)
*C22C 21/00* (2006.01)

(Continued)

(52) U.S. Cl.
CPC ..... *C23C 2/12* (2013.01); *C21D 8/0473* (2013.01); *C21D 8/0478* (2013.01); *C22C 21/06* (2013.01);

(Continued)

(58) Field of Classification Search
CPC ..... B32B 15/012
USPC ..... 428/653
See application file for complete search history.

(56) References Cited

U.S. PATENT DOCUMENTS

2009/0142616 A1* 6/2009 Fujii ..... 428/653

FOREIGN PATENT DOCUMENTS

CN 1369020 A 9/2002
EP 1 184 478 3/2002

(Continued)

OTHER PUBLICATIONS

English Machine Translation of Tsuru (JP 2010-168645), JPO, accessed Jan. 2, 2015.*

(Continued)

*Primary Examiner* — David Sample
*Assistant Examiner* — Lucas Wang
(74) *Attorney, Agent, or Firm* — DLA Piper LLP (US)

(57) ABSTRACT

An aluminum or aluminum alloy-coated steel material includes base steel; and a coating layer formed on a surface of the base steel and containing by mass % Mg: 6% to 10%, Si: 3% to 7%, Fe: 0.2% to 2%, Mn: 0.02% to 2%, and the balance as Al and incidental impurities, wherein the coating layer has pseudoternary eutectic microstructures of αAl—$Mg_2Si$—(Al—Fe—Si—Mn) and an area ratio of the pseudoternary eutectic microstructures in the coating layer is at least 30%.

2 Claims, 3 Drawing Sheets

(51) Int. Cl.

| | |
|---|---|
| ***C23C 2/12*** | (2006.01) |
| ***C22C 21/06*** | (2006.01) |
| ***C23C 2/28*** | (2006.01) |
| ***C21D 8/04*** | (2006.01) |
| *C21D 1/673* | (2006.01) |

(52) U.S. Cl.
CPC ..... *C23C 2/28* (2013.01); *C21D 1/673* (2013.01); *C21D 2211/004* (2013.01); *Y10T 428/12757* (2015.01)

(56) References Cited

FOREIGN PATENT DOCUMENTS

| | | | |
|---|---|---|---|
| JP | 4-259363 | A | 9/1992 |
| JP | 2000-239820 | A | 9/2000 |
| JP | 2005-272967 | A | 10/2005 |
| JP | 4199404 | B2 | 10/2008 |
| JP | 2010-168645 | A | 8/2010 |
| WO | 00/56945 | A1 | 9/2000 |

OTHER PUBLICATIONS

Taiwanese Office Action dated Apr. 8, 2014 from corresponding Taiwanese Patent Application No. 101146879 along with its English translation.
Supplementary European Search Report dated Apr. 7, 2015 of corresponding European Application No. 12856630.4.
Chinese Office Action dated Jun. 3, 2015 of corresponding Chinese Application No. 2012800606970 along with its English translation.
Notice of Grounds for Rejection dated Oct. 20, 2015 of corresponding Korean Application No. 2014-7015801 along with an English translation.

* cited by examiner

ALUMINUM OR ALUMINUM ALLOY-COATED STEEL MATERIAL AND METHOD OF MANUFACTURING THE SAME

TECHNICAL FIELD

This disclosure relates to an aluminum or aluminum alloy-coated steel material and method of manufacturing the same, in particular, to an aluminum or aluminum alloy-coated steel material having better corrosion resistance than predecessors, and method of manufacturing the same.

BACKGROUND

An aluminum or aluminum alloy-coated steel material is widely used in the fields of automobile mufflers and building materials as a coated steel material having excellent corrosion resistance and high-temperature oxidation resistance. However, there is a problem with such an aluminum or aluminum alloy-coated steel material as described above in that the steel material experiences very high coating elution rate to be easily corroded and cannot demonstrate satisfactory corrosion resistance in a wet environment, although generation of corrosion products is relatively mild and stable. Thus, the steel material exhibits good corrosion resistance in a dry environment.

In view of this, JP-A 2000-239820 discloses for the purpose of improving corrosion resistance of an aluminum or aluminum alloy-coated steel sheet a hot-dip aluminized steel sheet having: an intermetallic compound coating layer provided on a surface of a base steel sheet, containing Al, Fe, Si, and having ≤5 μm thickness; and a coating layer provided on a surface of the intermetallic compound coating layer and composed by weight % of 2 to 13% Si, >3% to 15% Mg and the balance which is substantially Al.

JP-B 4199404 discloses a steel sheet provided with a hot dip Al-based coating and having good corrosion resistance, characterized in that the hot dip Al-based coating is a hot dip Al—Mg—Si based coating layer formed on a surface of the base steel sheet and containing, by weight %, Mg: 3 to 10% and Si: 1 to 15%, and the balance Al with incidental impurities, wherein: the Al—Mg—Si based coating layer has a metallic structure composed of at least an Al phase and an $Mg_2Si$ phase; and the long diameter of the $Mg_2Si$ phase is controllably 10 μm or less.

Further, WO 2000/56945 discloses a surface treated steel material having aluminum-based coating layer, characterized in that: the Al-based coating layer formed on a surface of the base steel material contains massive intermetallic compound bodies composed of at least one type of Group IIa (alkaline-earth metal) element and at least one type of Group IVb element; and the long diameter of each intermetallic compound body is at least 1 μm and the ratio of the short diameter with respect to the long diameter is at least 0.4.

However, the coated steel materials of JP '820, JP 404 and WO '945 still have problems described below, respectively.

Specifically, the coated steel material of JP '820 has a problem in that massive $Mg_2Si$ phase or $Al_3Mg_2$ phase is precipitated in the coating layer and serves as the origin of dissolution, thereby facilitating localized dissolution of the coating layer. The coated steel material of JP '404 has a problem in that the hot dip Al—Mg—Si based coating layer experiences preferential dissolution of $Mg_2Si$ phase thereof. Thus, subsequent localized dissolution start from the vicinities of the preferential dissolution.

The coated steel material of WO '945 has a problem of preferential dissolution of the intermetallic compound phase and subsequent localized dissolution of the coating layer triggered by the preferential dissolution.

Also, we previously proposed a steel material having a sacrificial anticorrosive film, wherein the sacrificial anticorrosive film contains Al, Mg and Si, contents of Mg and Si are 6 to 10 mass % and 3 to 7 mass %, respectively, and a ratio of Mg/Si is 1.1 to 3.0, as disclosed in JP-A 2010-168645.

Corrosion resistance of a coated steel sheet improved to some extent as a result of development of the steel material of JP '645. However, corrosion resistance still locally deteriorates in the steel material of JP '645.

It could therefore be helpful to further improve corrosion resistance of a coated steel sheet by preventing localized deterioration of corrosion resistance in particular.

SUMMARY

We studied causes of such localized deterioration of corrosion resistance as described above in a steel sheet having Al-based coating layer formed thereon and, as a result, discovered that elongated needle/sheet-like Al—Fe compound precipitate in a coating layer serves as an origin of corrosion. Thus, the presence of this Al—Fe compound precipitate eventually causes corrosion of the coating layer.

Based on this discovery, we discovered that manganese added to a coating layer at an appropriate content forms pseudoternary eutectic microstructures of $\alpha$Al—$Mg_2Si$—(Al—Fe—Si—Mn) and the pseudoternary eutectic microstructures finely capture Fe-based compounds therein to improve corrosion resistance of the coated layer.

We thus provide:

(1) An aluminum or aluminum alloy-coated steel material, comprising: base steel; and a coating layer formed on a surface of the base steel and containing by mass % Mg: 6% to 10%, Si: 3% to 7%, Fe: 0.2% to 2%, Mn: 0.02% to 2%, and the balance as Al and incidental impurities, wherein the coating layer has pseudoternary eutectic microstructures of $\alpha$Al—$Mg_2Si$—(Al—Fe—Si—Mn) and an area ratio of the pseudoternary eutectic microstructures in the coating layer is at least 30%.

(2) The aluminum or aluminum alloy-coated steel material of (1) above, wherein molar ratios Mg/Si, Mn/Fe, and $Mg_2Si$/Al of the coating layer satisfy $1.7 \leq Mg/Si \leq 2.3$, $0.1 \leq Mn/Fe \leq 1.0$, and $Mg_2Si/Al \leq 1$, respectively.

(3) A method for manufacturing an aluminum or aluminum alloy-coated steel material, comprising the steps of: preparing a coating bath having a composition including by mass % Mg: 6% to 10%, Si: 3% to 7%, Fe: 2% or less (inclusive of 0%), Mn: 0.02% to 2%, and the balance as Al and incidental impurities; immersing a steel material to be subjected to coating treatment in the coating bath temperature in the range of (the melting point of the coating solution+20° C.) to 750° C. for a period of 0.5 second or longer; and cooling the steel material at cooling rate of 20° C./second or higher.

It is possible to provide an aluminum or aluminum alloy-coated steel material having better corrosion resistance than predecessors, together with a manufacturing method thereof.

BRIEF DESCRIPTION OF THE DRAWINGS

FIG. 2A shows a state of a coating layer having Al—Fe compound therein prior to corrosion and FIG. 2B shows a state of the coating layer after 3-day immersion thereof in 0.5 mol NaCl solution.

DETAILED DESCRIPTION

Our steel materials and methods will be described in detail hereinafter.

Our aluminum or aluminum alloy-coated steel material has base steel and a coating layer formed on a surface of the base steel, the coating layer containing by mass % Mg: 6% to 10%, Si: 3% to 7%, Fe: 0.2% to 2%, Mn: 0.02% to 2%, and the balance as Al and incidental impurities, wherein the coating layer has pseudoternary eutectic microstructures of αAl—$Mg_2Si$—(Al—Fe—Si—Mn) and area ratio of the pseudoternary eutectic microstructures in the coating layer is at least 30%.

Figure 2A:
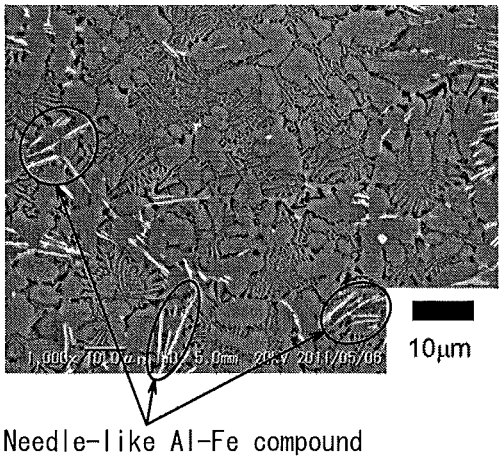
FIG. 2A and FIG. 2B are photographs each showing Al—Fe compound precipitated in a coating layer and, specifically.
Figure 2B:
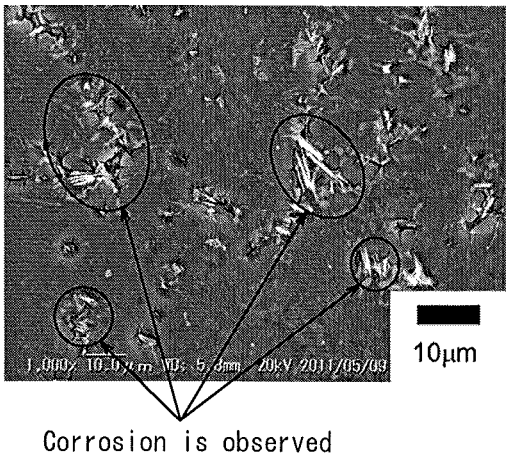

FIGS. 2A and 2B are photographs each showing Al—Fe compound precipitated in an aluminum-based coating layer.

Conventional Al alloy-coated steel sheets have a problem in that the steel sheets include elongated needle/sheet-like precipitate made of Al—Fe compound (which precipitate will be referred to as "needle-like Al—Fe compound" hereinafter) in a coating layer thereof, as shown in FIG. 2A, which Al—Fe compound servers as the origin of corrosion to eventually cause serious corrosion of the coating layer as shown in FIG. 2B.

Figure 1:
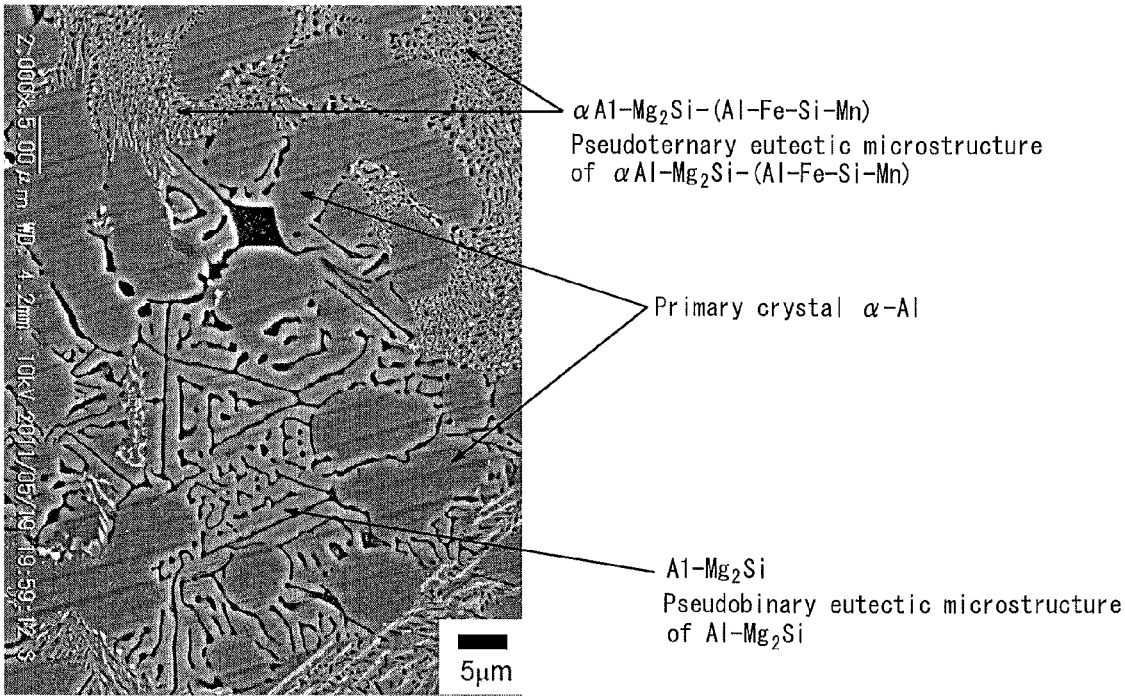
FIG. 1 is a photograph explaining pseudoternary eutectic microstructures of $\alpha$Al—$Mg_2Si$—(Al—Fe—Si—Mn) in a coating layer.

In contrast, in a case where pseudoternary eutectic microstructures of αAl—$Mg_2Si$—(Al—Fe—Si—Mn) constituted of αAl, $Mg_2Si$, and (Al—Fe—Si—Mn) has been formed in an Al-based coating layer of an Al alloy-coated steel material as shown in FIG. 1, the pseudoternary eutectic microstructures finely capture Fe component therein to prevent the needle-like Al—Fe compound which would possibly serve as the origin of corrosion from being precipitated so that the steel material can realize more excellent corrosion resistance than the conventional Al alloy-coated steel material.

The term "pseudoternary eutectic microstructures of αAl—$Mg_2Si$—(Al—Fe—Si—Mn)" represents eutectic microstructures constituted of three types of components, i.e., αAl, $Mg_2Si$, and a compound composed of Al, Fe, Si and Mn, as described above. The pseudoternary eutectic microstructures of αAl—$Mg_2Si$—(Al—Fe—Si—Mn) have finer configurations than the needle-like Al—Fe compound as shown in FIG. 1, and the average grain size (in the longitudinal direction) thereof is 0.5 μm to 5 μm or so. Specific examples of the pseudoternary eutectic microstructures include: the balance Al-7 mass % Mg-4 mass % Si-0.8 mass % Fe-0.1 mass % Mn; the balance Al-7.5 mass % Mg-4.3 mass % Si-1.2 mass % Fe-0.5 mass % Mn; the balance Al-8 mass % Mg-4.6 mass % Si-1.2 mass % Fe-0.5 mass % Mn; and the like.

The term "needle-like Al—Fe compound" represents a compound containing Al and Fe and examples thereof include α-AlFeSi, β-AlFeSi, η-AlFe, θ-AlFe, θ-AlFeSi, and the like. The "needle-like" configuration of the needle-like Al—Fe compound represents a configuration having a ratio of longer diameter with respect to shorter diameter (i.e., the aspect ratio) of at least 5 when microstructure of the compound is observed.

The area ratio of pseudoternary eutectic microstructures of αAl—$Mg_2Si$—(Al—Fe—Si—Mn) in the coating layer needs to be at least 30% because precipitation of the needle-like Al—Fe compound cannot be sufficiently reduced and thus corrosion resistance as desired cannot be obtained when the area ratio of the pseudoternary eutectic microstructure is less than 30%. The area ratio of pseudoternary eutectic microstructures of αAl—$Mg_2Si$—(Al—Fe—Si—Mn) is preferably at least 35%, more preferably at least 40%, and further more preferably at least 45% in terms of further improving corrosion resistance.

The "area ratio of pseudoternary eutectic microstructures of αAl—$Mg_2Si$—(Al—Fe—Si—Mn)" represents an area ratio of the pseudoternary eutectic microstructure occupied in a cross section of the coating layer, which ratio can be obtained, for example, by: measuring area of the pseudoternary eutectic microstructure in a given field selected for cross-sectional observation of the coating layer; and calculating the ratio (%) of the measured area with respect to the whole area of the observed field.

Precipitation of the needle-like Al—Fe compound is reduced as a result of formation of the pseudoternary eutectic microstructure in the coating layer. The presence of the needle-like Al—Fe compound in the coating layer is, however, tolerated as long as the area ratio thereof is 2% or less. The coating layer does not have so many origins of corrosion and thus possesses satisfactorily high corrosion resistance when the area ratio of the needle-like Al—Fe compound is 2% or less. The area ratio of the needle-like Al—Fe compound is preferably 1% or less and more preferably 0.5% or less.

The coating layer may also include pseudobinary eutectic microstructures of Al—$Mg_2Si$, as shown in FIG. 1. The presence of pseudobinary eutectic microstructures of Al—$Mg_2Si$ in the coating layer allows the coating layer to have microstructure in which fine $Mg_2Si$ having active corrosion potential is uniformly dispersed. Dissolution caused by anodic polarization of the pseudobinary eutectic microstructures and the pseudoternary eutectic microstructures occurs substantially uniformly over the coating layer, thereby effectively preventing non-uniform dissolution, i.e., localized corrosion, of the coating layer.

The area ratio of pseudobinary eutectic microstructures of Al—$Mg_2Si$ in the coating layer is not particularly restricted, but is preferably 0% to 40% and more preferably 10% to 25% in terms of reducing precipitation of the Al—Fe compound to obtain excellent corrosion resistance.

When the coating layer includes massive pseudobinary eutectic microstructures of $Mg_2Si$, longer diameter of massive $Mg_2Si$ is preferably less than 5 μm. Microstructure in which fine $Mg_2Si$ having active corrosion potential is uniformly dispersed can be obtained when longer diameter of massive $Mg_2Si$ is less than 5 μm.

The remaining microstructure of the coating layer is predominantly constituted of primary crystal αAl, as shown in FIG. 1.

The coating layer of the Al alloy-coated steel material contains by mass % Mg: 6% to 10%, Si: 3% to 7%, Fe: 0.2% to 2%, Mn: 0.02% to 2%, and the balance as Al and incidental impurities.

Mg: 6 mass % to 10 mass %

Magnesium is an element to be contained in the coating layer to maintain uniform dissolution properties and ensure good sacrificial anticorrosive properties of the coating layer. The content of magnesium in the coating layer is 6 mass % to 10 mass %. Satisfactorily uniform dissolution properties and sufficiently good sacrificial anticorrosive properties of the coating layer cannot be obtained when Mg content in the coating layer is less than 6 mass %. A content of Mg in the coating layer exceeding 10 mass %, however, results in precipitation of massive $Mg_2Si$ or $Al_3Mg_2$ having large size, thereby possibly deteriorating corrosion resistance of the coating layer.

Si: 3 mass % to 7 mass %

Silicon is an element to be contained in the coating layer to evenly disperse Mg in the form of fine eutectic microstructure of $Mg_2Si$ in the coating layer to obtain satisfactorily uniform dissolution properties of the coating layer. The content of silicon in the coating layer is 3 mass % to 7 mass %. A content of Si in the coating layer less than 3 mass % causes excessive Mg to be precipitated as $Al_3Mg_2$ in the coating layer to accelerate localized dissolution of the coating layer. A content of Si in the coating layer exceeding 7 mass % may, however, result in precipitation of massive $Mg_2Si$ having undesirably large size.

Fe: 0.2 mass % to 2 mass %

Iron is an element eventually contained in the coating layer as a result of Fe, dissolved from the base steel and mixed into the coating bath, entering the coating layer when it is formed on the base steel material. The upper limit of Fe content in the coating layer is 2 mass % in view of the saturated solubility of Fe in the coating bath. Hypothetically, a content of Fe in the coating layer exceeding 2 mass %, i.e., too high a Fe content, would possibly result in too much precipitation of the needle-like Al—Fe compound and thus unsatisfactory corrosion resistance of the coating layer. The lower limit of Fe content in the coating layer is 0.2 mass % because corrosion induced by precipitation of the Al—Fe compound hardly occurs and the superior effect is not sufficiently demonstrated when Fe content in the coating layer is less than 0.2 mass %.

Mn: 0.02 mass % to 2 mass %

Manganese is an element required to form pseudoternary eutectic microstructures of $\alpha$Al—$Mg_2Si$—(Al—Fe—Si—Mn) in the coating layer. The presence of Mn in the coating layer allows Fe to form (Al—Fe—Si—Mn), which is more stable than the needle-like Al—Fe compound and can be fine precipitate at a relatively high cooling rate, whereby the pseudoternary eutectic microstructure is successfully formed in the coating layer. The content of manganese in the coating layer is 0.02 mass % to 2 mass % and preferably 0.1 mass % to 2 mass %. A content of Mn in the coating layer less than 0.02 mass % results in insufficient formation of the pseudoternary eutectic microstructures of $\alpha$Al—$Mg_2Si$—(Al—Fe—Si—Mn). Content of Mn in the coating layer exceeding 2 mass %, however, causes Mn to form another type of Mn-containing compound to disturb satisfactory formation of the pseudoternary eutectic microstructure.

Incidental Impurities

The coating layer includes incidental impurities, mixed thereto due to diffusion from the base steel and/or derived from raw materials of the aluminum alloy. Examples of the incidental impurities include Cr, Cu, Mo, Ni, Ti, Zr, and the like. The total content of these incidental impurities is not particularly restricted but preferably 1 mass % or less in terms of maintaining satisfactory corrosion resistance and uniform dissolution properties of the coating layer. Specifically, the contents of the above-exemplified incidental impurities are Cr: 100 mass ppm or less, Cu: 100 mass ppm or less, Mo: 100 mass ppm or less, Ni: 100 mass ppm or less, Ti: 100 mass ppm or less, and Zr: 10 mass ppm or less, respectively.

Further, molar ratios Mg/Si, Mn/Fe, and $Mg_2Si$/Al preferably satisfy $1.7 \leq Mg/Si \leq 2.3$, $0.1 \leq Mn/Fe \leq 1.0$, and $Mg_2Si/Al \leq 1$, respectively, in the coating layer.

$1.7 \leq Mg/Si \leq 2.3$

Mg and Si are elements both required to form the pseudobinary eutectic microstructures of Al—$Mg_2Si$ as described above and the molar ratio of Mg with respect to Si (Mg/Si) is preferably 1.7 to 2.3. $Mg/Si \geq 1.7$ reliably avoids a state where Mg content is too low relative to Si content and $Mg/Si \leq 2.3$ reliably avoids a state where Si content is too low relative to Mg content. That is, Mg/Si 1.7 to 2.3 ensures satisfactory formation of pseudobinary eutectic microstructures of Al—$Mg_2Si$.

$0.1 \leq Mn/Fe \leq 1.0$

Fe and Mn are elements both required to form the pseudoternary eutectic microstructures of $\alpha$Al—$Mg_2Si$—(Al—Fe—Si—Mn) as described above and the molar ratio of Mn with respect to Fe (Mn/Fe) is preferably 0.1 to 1.0. $Mn/Fe \geq 0.1$ reliably avoids a state where Mn content is too low relative to Fe content. $Mn/Fe \leq 1.0$ reliably avoids a state where Mn content is too high relative to Fe content, thereby preventing formation of an irrelevant Mn-containing compound. That is, Mn/Fe 0.1 to 1.0 ensures satisfactory formation of the pseudoternary eutectic microstructures.

$Mg_2Si/Al \leq 1$

The molar ratio of $Mg_2Si$ with respect to Al ($Mg_2Si/Al$)$\geq 1$ reliably avoids a state where $Mg_2Si$ content is too high relative to Al content, thereby ensuring satisfactory formation of the pseudobinary eutectic microstructures of Al—$Mg_2Si$. As a result, $Mg_2Si/Al \leq 1$ reliably prevents too much precipitation of the needle-like Al—Fe compound, thereby ensuring uniform dissolution of the coating layer.

The coating amount of the coating layer is not particularly restricted and may be appropriately set according to applications and the like. For example, a coating amount of the coating layer is preferably at least 25 $g/m^2$ in terms of reliably obtaining desired corrosion resistance of the layer. The upper limit of the coating amount of the coating layer is preferably 125 $g/m^2$ in terms of ensuring good formability of the layer.

A predetermined chemical conversion coating may be formed on the coating layer according to necessity. Corrosion resistance, adhesion properties, scratch/abrasion resistance and the like of the coating layer can be further improved by providing a chemical conversion coating thereon. The type of the chemical conversion coating is not particularly restricted, but the chemical conversion coating is preferably free of chromium in view of environmental friendliness. The chemical conversion coating preferably contains: silica fine particles in terms of ensuring good adhesion properties and good corrosion resistance of the chemical conversion coating; and phosphoric acid and/or phosphate compound in terms of ensuring good corrosion resistance of the coating. It is preferable that the chemical conversion coating contains silica fine particles capable of effectively improving adhesion properties of the chemical conversion coating (dry type silica in particular), although either wet type silica or dry type silica may be used as the silica fine particles. Regarding the phosphoric acid and the phosphate compound, it suffices, for example, that the chemical conversion coating contains at least one type of substance selected from orthophosphoric acid, pyrophosphoric acid, and polyphosphoric acid and metal salts and compounds thereof. Further, a predetermined coating film may be further provided on either the coating layer or the chemical conversion coating.

Types of the base steel material on which the coating layer is formed is not particularly restricted as long as the coating layer can be formed on a surface the base steel material. Examples of the base steel material include a steel sheet, a steel pipe, a steel bar, and the like.

Manufacturing Method

A method of manufacturing an aluminum or aluminum alloy-coated steel material characteristically includes the steps of: preparing a coating bath having a composition including by mass % Mg: 6% to 10%, Si: 3% to 7%, Fe: 2% or less (inclusive of 0%), Mn: 0.02% to 2%, and the balance as Al and incidental impurities; immersing a steel material to be subjected to coating treatment in the coating bath temperature of (the melting point of the coating bath+20° C.) to 750° C. for a period of 0.5 second or longer; and cooling the steel material at cooling rate of 20° C./second or higher.

In the coating layer of the aluminum or aluminum alloy-coated steel material manufactured by the aforementioned manufacturing method, precipitation of the needle-like Al—Fe compound, which compound could serve as the origin of corrosion, can be significantly reduced. As a result, the Al alloy-coated steel material has much better corrosion resistance than the conventional Al alloy-coated steel material.

Steel Material to be Subjected to Coating Treatment

The type of a steel material to be subjected to coating treatment in the manufacturing method is not particularly restricted and examples of the steel material include a steel sheet, a steel pipe, a steel bar, and the like.

A method of obtaining the steel material to be subjected to coating treatment is not particularly restricted. For example, in the case where the steel material is a steel sheet, the steel sheet may be manufactured by a method including hot rolling, pickling, cold rolling and recrystallization annealing processes in this order.

The hot rolling process may be carried out according to a conventional method including slab heating, rough rolling, finish rolling and coiling. Heating temperature, finish rolling temperature and the like are not particularly restricted, either, and the conventionally used temperatures are applicable thereto.

The pickling process after the hot rolling may also be carried out according to a conventional method and examples thereof include rinsing with hydrochloric acid or sulfuric acid.

The cold rolling process after pickling is not particularly restricted either, and may be carried out, e.g., at reduction rate in the range of 30% to 90%. The reduction rate equal to or higher than 30% reliably prevents the mechanical properties of the resulting steel sheet from deteriorating and rolling reduction rate not exceeding 90% reliably curtails rolling cost within a reasonable range.

The recrystallization annealing process can be carried out, for example, by: cleaning the steel sheet through degreasing and the like; and heating the steel sheet thus cleaned to a predetermined temperature in a heating zone and then subjecting the steel sheet to a predetermined thermal treatment in a subsequent soaking zone in an annealing furnace of a continuous hot-dip coating line. Temperature conditions during the recrystallization process are set preferably according to the mechanical properties required of the steel sheet. The annealing process is to be carried out in the annealing furnace under an atmosphere capable of reducing Fe so that a surface layer of the steel sheet prior to the coating process is activated. Type of a reducing gas is not particularly restricted but a known reducing gas atmosphere conventionally in use is preferable.

Coating Bath

The coating bath for use in the manufacturing method has a composition including by mass % Mg: 6% to 10%, Si: 3% to 7%, Fe: 2% or less (inclusive of 0%), Mn: 0.02% to 2%, and the balance as Al and incidental impurities.

In connection with the aforementioned specific ranges of the respective compositional components of the coating bath, "0%" of Fe content in the coating bath represents a case using a brand new coating bath in which no steel material has ever been immersed.

The coating bath temperature of the coating bath is (the melting point of the coating bath+20° C.) to 750° C. The lower limit of the coating bath temperature is (the melting point of the coating bath+20° C.) because the coating bath temperature must be at least equal to or higher than the solidifying point of the coating bath to carry out hot-dip coating treatment and setting the lower limit at (the melting point of the coating bath+20° C.) reliably prevents the compositional components of the coating bath from locally solidified due to localized drop of coating bath temperature during the coating treatment. The upper limit of the coating bath temperature is 750° C. because the coating bath temperature exceeding 750° C. makes rapid cooling of the coating layer difficult, thereby increasing thickness of a Al—Fe alloy layer formed between the coating layer and the base steel sheet.

Steel Sheet Temperature upon Immersion

The temperature of the steel material (sheet) to be subjected to coating when the steel material is immersed into the coating bath, i.e., steel sheet temperature upon immersion, is not particularly restricted, but is preferably controllably within ±20° C. with respect to the coating bath temperature in terms of ensuring good coating properties and suppressing change in the coating bath temperature during the continuous hot-dip coating operation.

Immersion Time

Time during which the steel material subjected to the coating treatment is immersed in the coating bath is at least 0.5 second. The immersion time shorter than 0.5 second may result in insufficient formation of the coating layer on a surface of the steel material subjected to the coating treatment. The upper limit of the immersion time is not particularly restricted but too long immersion time may undesirably thicken an Al—Fe alloy layer formed between the coating layer and the base steel sheet. Five seconds or so presumably suffice to satisfactorily form the coating layer.

Conditions in connection with how the steel material is to be immersed into the coating bath are not particularly restricted. For example, line speed may be 150 mpm to 230 mpm when mild steel (sheet) is subjected to coating or 40 mpm or so when a heavy plate is subjected to coating. Length to be immersed, of the steel material, may be 5 m to 7 m or so.

Cooling Rate

Cooling rate of the steel material after immersion in the coating bath is critically important in the manufacturing method. Specifically, the steel material, after being immersed in the coating bath, is cooled at cooling rate of at least 20° C./second. It is possible to form desired pseudoternary eutectic microstructures of $\alpha$Al—$Mg_2Si$—(Al—Fe—Si—Mn) in the coating layer thus provided and prevent the Al—Fe alloy layer formed between the coating layer and the base steel sheet from being thickened by rapidly cooling the steel material at a rate of 20° C./second or higher.

Figure 3:
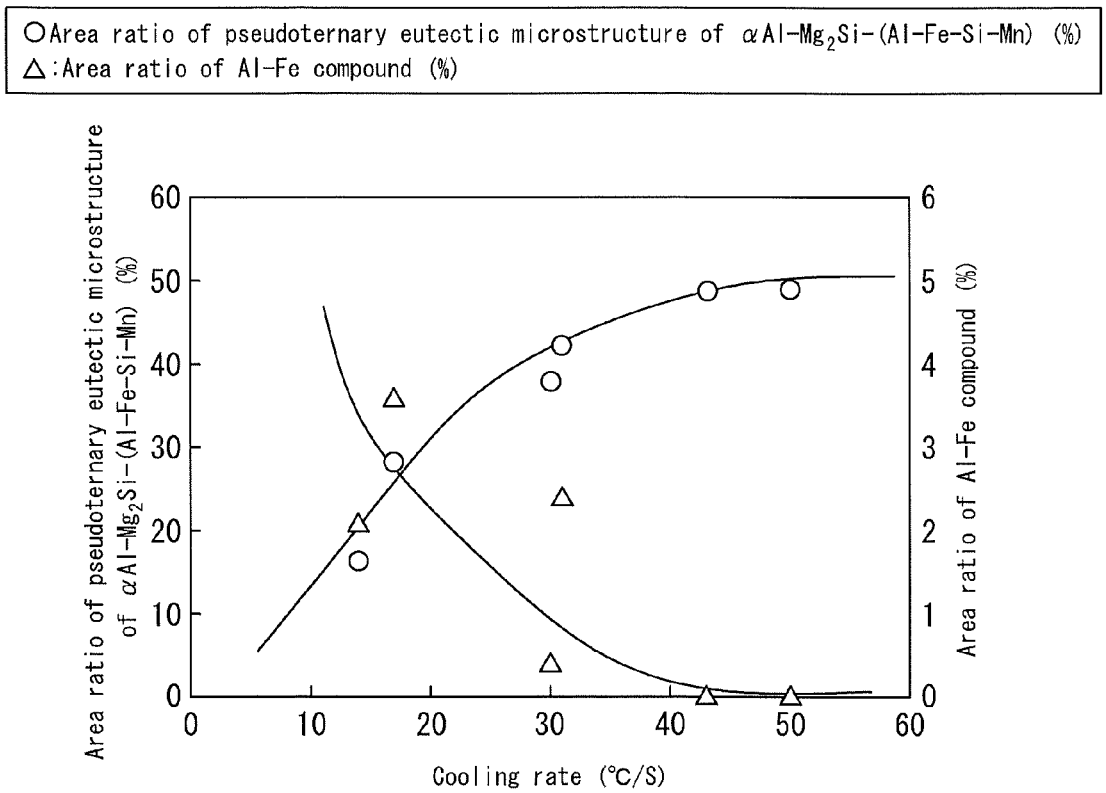
FIG. 3 is a graph showing relationships between cooling rate after immersion into coating bath, area ratio (%) of pseudoternary eutectic microstructures of αAl—$Mg_2Si$—(Al—Fe—Si—Mn) in a resulting coating layer, and area ratio (%) of the needle-like Al—Fe compound in the coating layer.

FIG. 3 shows the results of investigation of relationships between the cooling rate (° C./second) when the steel material subjected to coating was cooled after immersion in the coating bath, area ratio (%) of pseudoternary eutectic microstructures of αAl—$Mg_2Si$—(Al—Fe—Si—Mn) in a resulting coating layer, and area ratio (%) of the needle-like Al—Fe compound in the coating layer. It is understood from FIG. 3 that the higher cooling rate results in the larger area ratio of the pseudoternary eutectic microstructures and the smaller area ratio of the needle-like Al—Fe compound. The cooling rate is at least 20° C./second in the manufacturing method to ensure that the area ratio of the pseudoternary eutectic microstructure in the coating layer is at least 30%. The cooling rate is preferably at least 25° C./second, more preferably at least 30° C./second, and further more preferably at least 35° C./second.

Other Conditions

Other conditions in the Al alloy coating treatment than those described above are not particularly restricted and may be carried out according to conventional methods.

EXAMPLES

Next, superior effects will be described by Examples and Comparative Examples. These Examples are provided only for the purpose of explanation and by no means restrict it.

Samples 1-7

Al alloy-coated steel sheet samples were prepared by: annealing cold rolled steel sheets in a reducing gas at 800° C. for 30 seconds; immersing the respective steel sheets whose temperature is 700° C. in coating bath kept at 680° C. for 5 seconds for hot-dip coating; and cooling the respective steel sheets after the hot-dip coating at variously adjusted cooling rates (see Table 1) to control microstructures of the coating layer. The coating amount per one surface of each Al alloy-coated steel sample thus obtained, as well as composition and microstructure of the coating layer of the Al alloy-coated steel sheet sample, are shown in Table 1.

The coating amount was measured by gravimetry and the composition was determined by chemical analysis for each of the coated steel sheet samples thus obtained. Further, pseudoternary eutectic microstructures of αAl—$Mg_2Si$—(Al—Fe—Si—Mn), pseudobinary eutectic microstructures of Al—$Mg_2Si$, α-Al, and the needle-like Al—Fe compound of each of the coated steel sheet samples were observed by scanning electron microscopy (×500 and ×2000) to calculate area ratios thereof, respectively. The area ratios of pseudoternary eutectic microstructures of αAl—$Mg_2Si$—(Al—Fe—Si—Mn), pseudobinary eutectic microstructures of Al—$Mg_2Si$, α-Al, and the needle-like Al—Fe compound of each of the coated steel sheet samples thus calculated are shown in Table 1.

TABLE 1

| Sample ID No. | Coating layer: Composition (mass %) Mg | Si | Fe | Mn | Mole ratio Mg/Si | Mn/Fe | $Mg_2Si$/Al | Area ratio of pseudo-ternary eutectic micro-structures (%) | Area ratio of pseudo-binary eutectic micro-structures (%) | Area ratio of αAl (%) | Area ratio of needle-like Al—Fe compound (%) | Coating amount ($g/m^2$) | Coating treatment Cooling rate after coating bath immersion (° C. $s^{-1}$) | Note |
|---|---|---|---|---|---|---|---|---|---|---|---|---|---|---|
| 1 | 7 | 4 | 0.8 | 0.1 | 2.0 | 0.13 | 0.088 | 32.1 | 35.2 | 32.2 | 0.5 | 40 | 25 | Example |
| 2 | 7 | 4 | 1.2 | 0.3 | 2.0 | 0.25 | 0.089 | 47.0 | 20.5 | 32.5 | 0 | 30 | 30 | Example |
| 3 | 7 | 4 | 1.2 | 0.4 | 2.0 | 0.34 | 0.089 | 46.3 | 14.9 | 38.8 | 0 | 43 | 25 | Example |
| 4 | 7 | 4 | 1.5 | 0.9 | 2.0 | 0.61 | 0.090 | 46.4 | 13.8 | 39.8 | 0 | 32 | 30 | Example |
| 5 | 7 | 4 | 0.8 | 0 | 2.0 | 0 | 0.088 | 1.0 | 49.3 | 43.4 | 6.3 | 58 | 15 | Comp. Ex. |
| 6 | 7 | 4 | 0.3 | 0 | 2.0 | 0 | 0.088 | 2.5 | 48.3 | 45.0 | 4.2 | 40 | 17 | Comp. Ex. |
| 7 | 8.2 | 5 | 0.3 | 0 | 1.9 | 0 | 0.105 | 1.0 | 92.4 | 2.0 | 4.6 | 55 | 20 | Comp. Ex. |

"Example" represents Example according to the disclosure.
"Comp. Ex." represents Comparative Example out of the scope of the disclosure.

Evaluation

Each of the coated steel sheet samples was evaluated with regard to following physical properties.

(1) Corrosion Resistance

Each of the coated steel sheet samples was immersed in 0.5 $kmol/m^3$ NaCl aqueous solution and a coated surface of the sample was observed visually and by using an optical microscope 7 days after the immersion.

The state of the coated surface after the 7-day immersion thus observed was evaluated according to following criteria. The evaluation results are shown in Table 2.

○: No dissolution of coating layer and no adhesion of corrosion product are observed.

Δ: Coating layer is partially dissolved and covered with corrosion product.

x: Coating layer is entirely dissolved and covered with red rust.

(2) Sacrificial Anticorrosive Properties

Each of the coated steel sheet samples had the coating layer cut such that an X-shaped scar having 1 mm width at the coating layer exposed the base steel sheet. The sample was then immersed in 0.5 $kmol/m^3$ NaCl aqueous solution for 3 days. The corrosion state at the scar of the steel sheet sample was observed visually and by using an optical microscope.

Further, for each of the coated steel sheet samples, the coated steel sheet sample and another steel sheet made of the same material as the base steel of the sample were connected to each other either in an electrically short circuited state or via a zero shunt ammeter and then immersed in 0.5 $kmol/m^3$ NaCl aqueous solution for 7 days. The corrosion state of a coated surface of the steel sheet sample was observed visually and by using an optical microscope. Surface area ratio of the coated steel sheet sample with respect to the another steel sheet was 10:1.

The results of the observation was evaluated according to the following criteria. The evaluation results are shown in Table 2.

○: Base steel surface at the scar of the coated steel sheet sample (which will be referred to "surface A" hereinafter) and surface of the steel sheet sample after 7-day immersion in a state of being electrically connected with the coated steel sheet sample (which will be referred to "surface B" hereinafter) each exhibit no corrosion and maintain metallic luster.

Δ: Surface A and Surface B each exhibit no generation of red rust but Surface A or Surface B exhibits discoloration.

x: At least one of Surface A and Surface B is covered with red rust.

(3) Resistance to Localized Corrosion

Each of the coated steel sheet samples was immersed in 0.5 mol/L NaCl aqueous solution and a coated surface of the sample was observed visually and by using an optical microscope, 7 days after the immersion started, to confirm presence/absence of localized dissolution of the coating layer. The state of the coated surface after the 7-day immersion was evaluated according to following criteria. The evaluation results are shown in Table 2.

○: No localized dissolution has occurred at a coated surface of the coating layer.

x: Localized dissolution is observed at a coated surface of the coating layer.

TABLE 2

| | Evaluation | | | |
|---|---|---|---|---|
| Sample ID No. | Corrosion resistance | Sacrificial anticorrosive properties | Resistance to localized corrosion | Note |
| 1 | ○ | ○ | ○ | Example |
| 2 | ○ | ○ | ○ | Example |
| 3 | ○ | ○ | ○ | Example |
| 4 | ○ | ○ | ○ | Example |
| 5 | ○ | ○ | x | Comp. Ex. |
| 6 | ○ | ○ | x | Comp. Ex. |
| 7 | ○ | ○ | x | Comp. Ex. |

It is understood from Table 2 that samples 1 to 4 as our Examples are excellent in resistance to localized corrosion in particular, as compared to samples 5 and 6 as Comparative Examples. The samples as our Examples exhibit good results presumably because pseudoternary eutectic microstructures of αAl—$Mg_2Si$—(Al—Fe—Si—Mn) have been formed at a sufficiently high ratio in the coating layers thereof, whereby corrosion starting from the needle-like Al—Fe compound was suppressed. In contrast, the needle-like Al—Fe compound served as the origin of corrosion, thereby presumably facilitating occurrence of localized corrosion in the samples as Comparative Examples.

INDUSTRIAL APPLICABILITY

It is possible to provide an Al alloy-coated steel material being excellent in resistance to localized corrosion in particular as compared with the conventional Al alloy-coated steel material products, together with the manufacturing method thereof, by forming a coating layer having pseudoternary eutectic microstructures of αAl—$Mg_2Si$—(Al—Fe—Si—Mn) therein.

The invention claimed is:

1. An aluminum alloy-coated steel material, comprising:

base steel; and a coating layer formed on a surface of the base steel and consisting of by mass % Mg: 6% to 10%, Si: 3% to 7%, Fe: 0.2% to 2%, Mn: 0.02% to 2%, and the balance as Al and incidental impurities, wherein molar ratios Mg/Si, Mn/Fe, and $Mg_2Si$/Al of the coating layer satisfy $1.7 \leq Mg/Si \leq 2.3$, $0.1 \leq Mn/Fe \leq 1.0$, and $Mg_2Si/Al \leq 1$, respectively, and the coating layer has pseudoternary eutectic microstructures of αAl—$Mg_2Si$—(Al—Fe—Si—Mn) and an area ratio of the pseudoternary eutectic microstructures in the coating layer is at least 30%.

2. A method of manufacturing an aluminum alloy-coated steel material of claim 1, comprising:

preparing a coating bath having a composition consisting of by mass % Mg: 6% to 10%, Si: 3% to 7%, Fe: 2% or less (inclusive of 0%), Mn: 0.02% to 2%, and the balance as Al and incidental impurities;

immersing a steel material to be subjected to coating treatment in the coating bath temperature at (melting point of the coating bath+20° C.) to 750° C. for a period of 0.5 second or longer; and cooling the steel material at cooling rate of 20° C./second or higher.

* * * * *